US006032329A

United States Patent [19]

Casali

[11] Patent Number: 6,032,329

[45] Date of Patent: Mar. 7, 2000

[54] DEVICE FOR MANUAL RELEASE OF A GATE FROM A RESPECTIVE POWERED ACTUATOR

[75] Inventor: Celestino Casali, Nembro, Italy

[73] Assignee: Automatica Casali s.r.l., Italy

[21] Appl. No.: 09/015,195

[22] Filed: Jan. 29, 1998

[30] Foreign Application Priority Data

Feb. 5, 1997 [IT] Italy ..... MI97U0075

[51] Int. Cl.[7] ..... E05F 1/00

[52] U.S. Cl. ..... 16/71; 49/139

[58] Field of Search ..... 16/49, 71, 72, 16/DIG. 17, 65, 70, 80; 49/139

[56] References Cited

U.S. PATENT DOCUMENTS 4,190,926 3/1980 Cronin ..... 16/65

5,862,569 1/1999 Wood ..... 16/49

*Primary Examiner*—Chuck Y. Mah

*Assistant Examiner*—Donald M. Gurley

*Attorney, Agent, or Firm*—Shlesinger, Fitzsimmons & Shlesinger

[57] ABSTRACT

A device (10) designed to be placed between a gate (12) and a powered actuator (16) to permit release on command and free movement of the gate with respect to the actuator. The device comprises a first plate (11) designed to be fastened to the gate and a second plate (17) designed to be connected kinetically to the actuator. A first and a second plate are supported to rotate freely around a common rotation axis (13) designed to coincide with the gate rotation axis. Means of bolt engagement (18) are arranged to engage between them a first and a second plate to make them integral. Two operating levers (19,20) each arranged on one side of the device and having cam surfaces (31,32) to cause independent backing of the bolt (24) of the engagement means (18) against the thrust of elastic means (25) to move it towards a disengagement position upon movement of one of the two operating levers from a rest position to an operating position. Locks (22,23) can be provided to prevent inappropriate operation of the levers.

8 Claims, 2 Drawing Sheets

Tav. I 10
11
12
13
14
15
16
17
18
19
20
21
22
23
24
26
27
32

Tav. II

DEVICE FOR MANUAL RELEASE OF A GATE FROM A RESPECTIVE POWERED ACTUATOR

BACKGROUND OF THE INVENTION

The present invention relates to a device to be arranged between a gate and a powered drive to allow their release in case of need.

Release devices to be arranged under the wing of a gate and comprising a manually operated bolt for separating the geared wing-moving motor from the wing to permit manual movement of the wing in case of need are known.

To avoid undue use of these devices they are usually equipped with a key lock which must be operated to allow release. There have been proposed devices in which the lock acts positively to release the bolt. In these devices by operating the lock a bolt stop rocker arm is freed so that the interaction of appropriate inclined planes permits free backing of the bolt when the gate is moved manually. Another cam means resets the bolt for the next snap engagement once the lock in locked position is operated again.

Similar devices are relatively complicated and jam easily. As retraction of the bolt is caused only by interaction of the bolt with an inclined plane delimiting its engagement seat it is not possible to manually exert enough force to release it if the mechanism which usually holds the bolt in engaged position jams. Since the device must be arranged near the ground in a poorly protected position and as its operation is very occasional, foreign bodies, mud, dirt and water can lead in time with high probability to jamming of the entire mechanism with no possibility of forced release in case of need.

In addition the movement stress transmitted to the gate by powered operation is partially transmitted to the lock with the risk of putting the mechanism out of commission and the need of having to provide strong hence costly locks. In case of breakage of the lock in open condition it is impossible to again engage the bolt and powered movement of the gate.

The general purpose of the present invention is to obviate the above mentioned shortcomings by making available a device for manual release of a gate from its drive which would be simple, economical and reliable under all conditions.

SUMMARY OF THE INVENTION

In view of this purpose it was sought to make available in accordance with the present invention a device designed to be placed between a gate and a powered actuator to permit release on command and free movement of the gate with respect to the actuator and comprising a first plate designed to be fastened to the gate and a second plate designed to be connected kinetically to the actuator with a first and a second plate being supported to rotate around their own rotation axis and means of bolt engagement being arranged to engage between them a first and a second plate to make them integral characterized in that they comprise two operating levers each arranged on one side of the device and having cam surfaces to cause independent backing of the bolt of the engagement means against the thrust of elastic means to move it to a disengagement position upon movement of one of the two operating levers from a rest position to an operating position.

BRIEF DESCRIPTION OF THE DRAWINGS

To clarify the explanation of the innovative principles of the present invention and its advantages compared with the prior art there is described below with the aid of the annexed drawings a possible exemplifying embodiment thereof by way of non-limiting example applying said principles. In the drawings.

DETAILED DESCRIPTION OF THE INVENTION

Figures 1, 4:
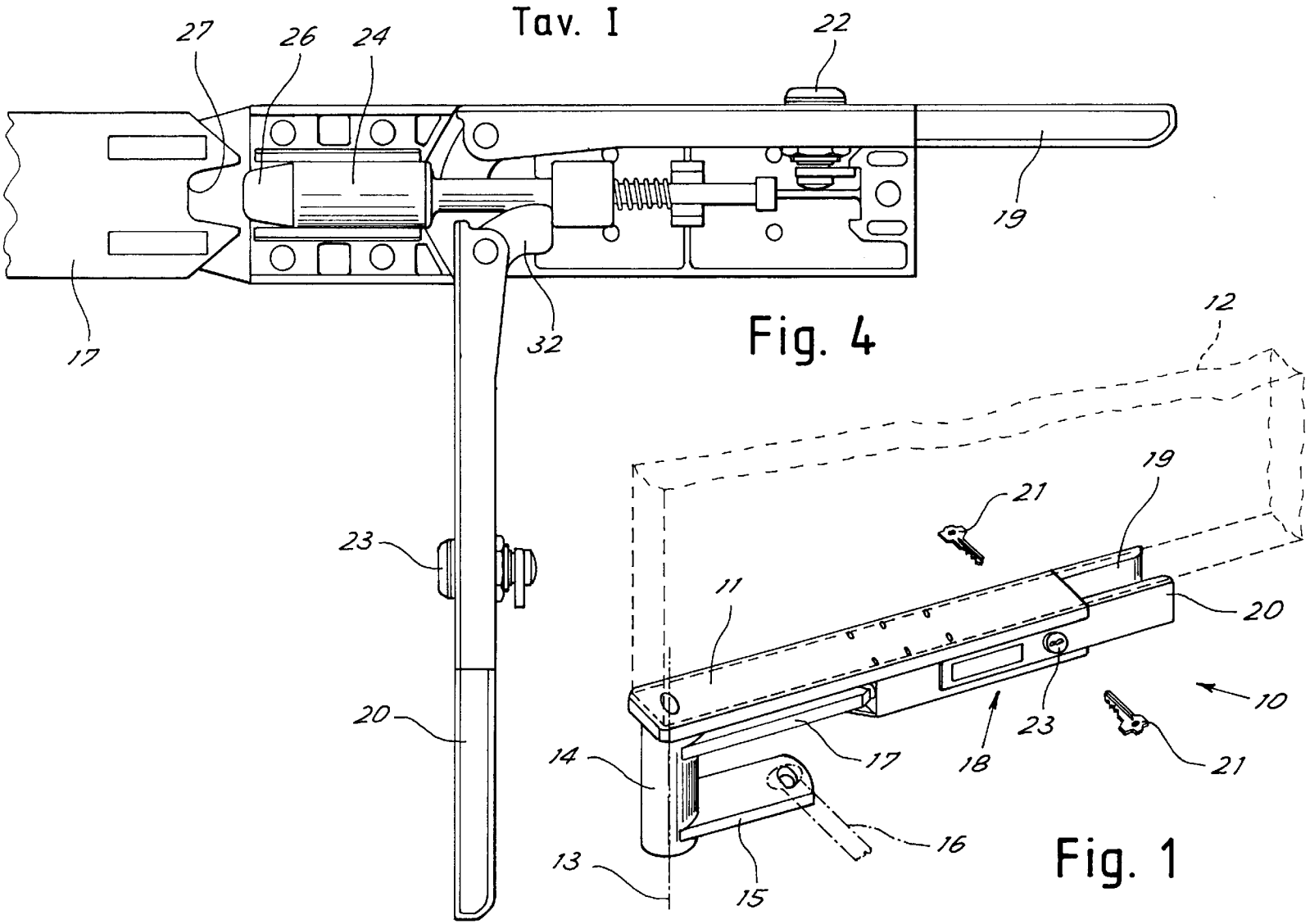
FIG. 1 shows a diagrammatic perspective view of a release device in accordance with the present invention.
FIG. 4 shows a view similar to that of FIG. 3 but with the device in release position.

With reference to the figures FIG. 1 shows diagrammatically a release device indicated as a whole by reference number 10 comprising a supporting rod or plate 11 designed to be connected under the wing of a gate indicated partially in broken lines with reference number 12. The rod 11 is mounted in a freely turning manner on a vertical axis 13. The axis 13 can for example coincide with the rotation axis of the gate. On the axis 13 is mounted coaxially a sleeve 14 which also turns freely. From the sleeve 14 projects radially a lever 15 designed to be connected to an actuator 16 for powered gate movement. The actuator, as may readily be imagined by one skilled in the art, can naturally be of any known type suited to acting on the lever 15 to rotate the sleeve around the axis 13.

From the sleeve 14 projects radially also a second engagement lever or plate 17 whose end remote from the sleeve 14 is engaged in a releasable constraint mechanism 18 supported integrally with an beneath the rod 11. As clarified below, the constraint mechanism is releasable through operation of either of the two levers 19, 20 after operation with a suitable wrench or key 21 of a corresponding lock 22, 23.

Figure 2:
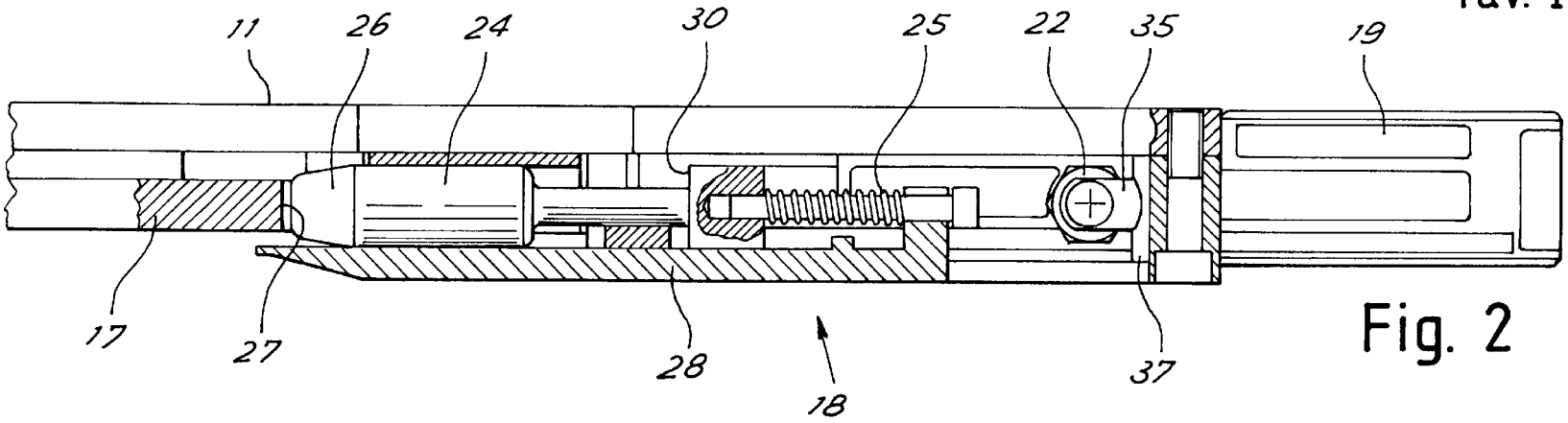
FIG. 2 shows a longitudinal cross section side view of FIG. 1.
Figure 3:
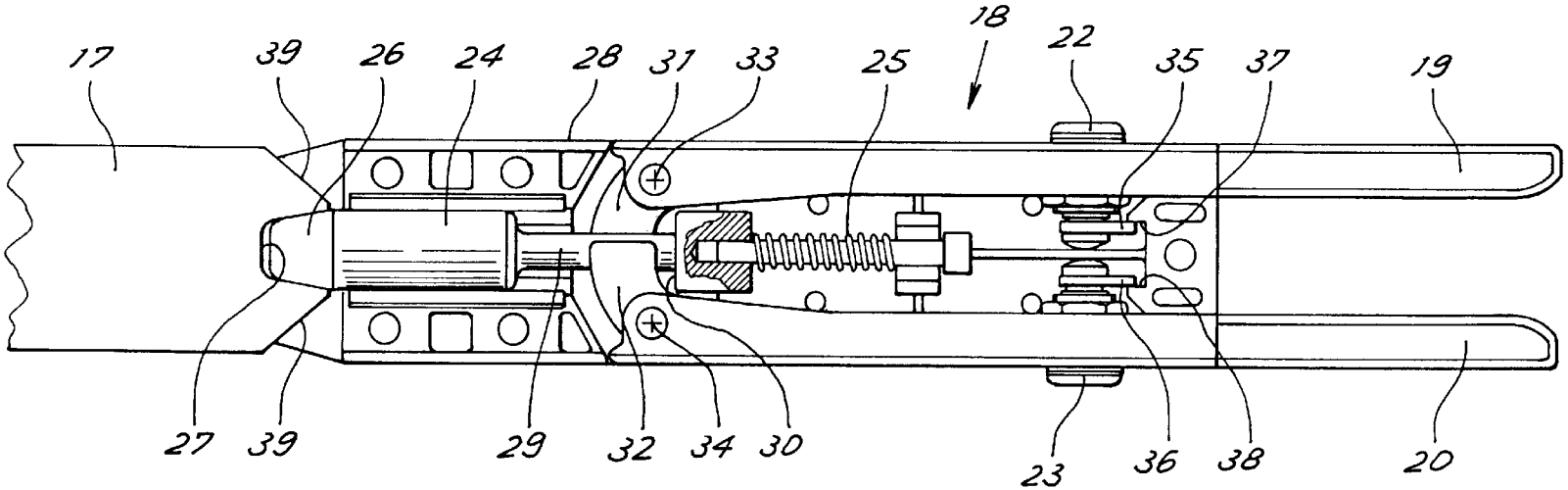
FIG. 3 shows a plan view of the device of FIG. 1 with parts removed.

As may be seen in FIGS. 2 and 3 the constraint mechanism 18 comprises a boxed shell or housing 28 whose upper wall can advantageously consist of the plate or rod 11 screwed thereto. The shell 28 contains a cylindrical bolt 24 which is thrust outward (from its FIG. 1 to its FIG. 3 position) by elastic means such as a helical spring 25 so as to engage the forward end 26 of the bolt in a complementary seat 27 on the end of the lever 17 when the lever 17 is parallel to the rod 11.

The seat 27 and the end 26 are slightly tapered to permit engagement with minimal play and avoid mutual restraint. The taper is however limited with respect to the angle of friction between the seat 27 and the bolt to avoid the bolt being thrust axially by a simple moment applied between the lever 17 and the rod 11 and overcoming the action of the spring 25.

The bolt 24 has intermediate its ends a reduce diameter tang 29 terminating in an enlarged diameter head defining a thrust surface 30 on which act independently cam ends or surfaces 31, 32 of the two operating levers 19, 20 pivoted on the boxed shell at 33, 34 respectively and parallel to the axis 13. The thrust spring 25 can act axially on the tang 29 advantageously. In rest position the two operating levers 19, 20 are advantageously arranged parallel to remain within the space occupied by the plate 11 on the two sides of the gate. As may be seen in FIG. 3 the levers can even partially form a mechanism shell side wall leaving free one of their rear ends for gripping and operation.

By moving an operating lever 19, 20 from the position of FIG. 3 to that of FIG. 4 the respective end pushes the bolt inward to disengage it from the seat 27 and permit free rotation of the plate 11 and thus the gate fastened thereto with respect to the lever 15. To prevent inappropriate operation of the levers 19, 20 each lever supports a key lock 22, 23 having a revolving plug 35, 36 which engages in an undercut 37, 38 integral with the shell 28.

When necessary to disengage the actuator from the gate it is sufficient thus to disengage one of the two locks and pull the corresponding operating lever. Disengagement of the bolt is ensured by the fact that the operating levers act directly on the bolt to cause it to retract from the engagement seat. Even if foreign matter were to enter the mechanism the ample arm of the operating levers would permit unlocking the bolt.

The structure is simple and reliable and emergency disengagement is always ensured. In addition, the locks act only to hold the levers in the rest position. They therefore must not resist the gate movement force. In case of breakage of the lock under conditions of free movement of the operating levers the disengagement mechanism remains fully operational for both engagement and disengagement of the device. The existence of two independent operating levers on opposite sides of the gate permits convenient manual operation from either side of the gate and makes the mechanism more reliable. For automatic resetting after operation of the disengagement device the bolt reception seat 27 may have inclined side surfaces 39 to facilitate retraction of the bolt during realignment movement of the lever 17 and the plate 11. Thus it is sufficient to bring the operating levers back to the rest position to cause the actuator to again engage automatically with the gate upon the first operation of the powered actuator to bring the lever 17 to meet the bolt.

Is now clear that the preset purposes have been achieved. Naturally the above description of an embodiment applying the innovative principles of the present invention is given by way of non-limiting example of said principles within the scope of the exclusive right claimed here. For example, the sizing of the various parts can vary depending on specific exigencies. The rotation axes of the parts 11 and 17 can also not coincide and the axis 13 can also not coincide with the gate axis. In the latter case there can be provided known kinematic mechanisms, for example shoes and cranks, for connection between the gate and the arm 11.

What is claimed is:

1. A device designed to be placed between a gate and a powered actuator to permit release on command and free movement of the gate with respect to the actuator and comprising, a first plate designed to be fastened to the gate, and a second plate designed to be connected kinetically to the actuator with said first and second plates being supported to rotate around a common axis, and means including a bolt releasably connecting said plates together for rotation in unison about said common axis, said means further including two operating levers arranged on opposite sides of the device for pivotal movement between operating and rest positions, respectively, and each of said levers having thereon a cam surface operative to cause said bolt to be retracted against the resistance of elastic means to a position in which said plates are disconnected from each other upon movement of either of said two operating levers from a rest position to an operating position.

2. Device in accordance with claim 1 including means for releasably locking the operating levers in their rest positions.

3. Device in accordance with claim 2 characterized in that said locking means comprises two locks each arranged to face a respective operating lever.

4. Device in accordance with claim 2 characterized in that the operating levers are pivoted on axes extending parallel to said common axis and are arranged in rest positions mutually parallel on the opposite sides of the device.

5. Device in accordance with claim 1 characterized in that for retraction of the bolt the cam surfaces of the operating levers act on a thrust surface which is integral with a tang projecting from one end of the bolt.

6. Device in accordance with claim 5 characterized in that the elastic means comprises a helical spring acting on said tang.

7. Device in accordance with claim 5 characterized in that the bolt and the operating levers are supported on the first plate and the second plate has therein a seat engageable by said bolt and having laterally inclined surfaces to facilitate snap engagement of said bolt in said seat.

8. Device in accordance with claim 1 characterized in that the second plate is secured to and is rotatable around said axis by a sleeve from which projects radially a lever for connection to the actuator.

* * * * *